US005120465A

United States Patent [19]

Sare et al.

[11] Patent Number: 5,120,465

[45] Date of Patent: Jun. 9, 1992

[54] DETERGENT OR CLEANSING COMPOSITION AND ADDITIVE FOR IMPARTING THIXOTROPIC PROPERTIES THERETO

[75] Inventors: Edward J. Sare, Berkeley Heights; George P. Larson, Roselle Park; Frank J. Botta, Linden, all of N.J.

[73] Assignee: Dry Branch Kaolin Company, Dry Branch, Ga.

[21] Appl. No.: 484,100

[22] Filed: Feb. 22, 1990

[51] Int. Cl.[5] ..... C11D 3/12; C11D 17/08

[52] U.S. Cl. ..... 252/174.25; 252/135; 252/174.14; 252/95; 252/99

[58] Field of Search ..... 556/173; 252/131, 174.25, 252/DIG. 8, 135, 179.14, 95, 99

[56] References Cited

U.S. PATENT DOCUMENTS

| | | | |
|---|---|---|---|
| 3,935,124 | 1/1976 | Thene | 252/131 |
| 3,985,668 | 10/1976 | Hartman | 252/99 |
| 4,123,395 | 10/1978 | Maquire et al. | 252/559 |
| 4,129,527 | 12/1978 | Clark et al. | 252/547 |
| 4,136,103 | 1/1979 | Oswald | 556/173 |
| 4,226,736 | 10/1980 | Bush et al. | 252/135 |
| 4,431,559 | 2/1984 | Ulrich | 252/99 |
| 4,699,730 | 10/1987 | Miles | 252/DIG. 8 |
| 4,740,327 | 4/1988 | Julemont et al. | 252/103 |
| 4,752,409 | 6/1988 | Drapier et al. | 252/94 |
| 4,753,748 | 6/1988 | Laitem et al. | 252/99 |
| 4,801,395 | 1/1989 | Chazard et al. | 252/99 |
| 4,836,946 | 6/1989 | Dixit | 252/97 |
| 4,844,824 | 7/1989 | Mermelstein et al. | 252/8.75 |
| 4,888,315 | 12/1989 | Bowman | 106/486 |
| 4,968,446 | 11/1990 | Ahmed et al. | 252/DIG. 14 |

*Primary Examiner*—Paul Lieberman
*Assistant Examiner*—Erin M. Higgins
*Attorney, Agent, or Firm*—Paul J. Lerner

[57] ABSTRACT

A thickening or suspending agent for imparting thixotropic properties to aqueous compositions, particularly LADD formulations, comprises a kaolinite clay admixed to the formulation at a level ranging from about 2% to about 5% by weight. While the thickening or suspending properties of the kaolinite clay are exhibited over a very broad range of particle size products, the kaolinite clay used advantageously has a particle size distribution of at least about 50% of the kaolin particles thereof have a particle size less than 2 microns equivalent spherical diameter, more preferably at least about 80% and, most perferably, at least about 95%. When utilized in a slurry form, the kaolinite clay based thickening or suspending agent most advantageously comprises an aqueous slurry of kaolinite particles at a solids level of at least 65% solids by weight. The thickening or suspending agent may also comprise a mixture of a kaolinite clay and a non-kaolinite selected from the group consisting of a smectite clay, attapulgite clay and mixtures thereof, preferably as a mixture of equal parts of kaolinite clay and attapulgite clay, and most preferably as a mixture of equal parts of a kaolinite clay and a bentonite clay.

20 Claims, No Drawings

DETERGENT OR CLEANSING COMPOSITION AND ADDITIVE FOR IMPARTING THIXOTROPIC PROPERTIES THERETO

BACKGROUND OF THE INVENTION

The present invention relates generally to detergent or cleansing compositions in viscous liquid or gel-like form which possess thixotropic properties. More specifically, the present invention relates to a kaolinite clay additive for imparting thixotropic properties to such compositions and, more particularly, to liquid automatic dishwasher detergent compositions incorporating a kaolinite clay thickening agent for imparting thixotropic properties thereto.

Thixotropic cleansing and detergent compositions suitable for various applications are well known in the art. Commercially available cleansing and detergent compositions typically incorporate therein certain expandable layered clays, i.e., aluminosilicates or magnesium silicates, which exhibit the ability of the layered clay structure to swell or expand on contact with water. Clays commercially available as thixotropic agents are those clays classified geologically as smectites (or montmorillonoids) and attapulgites (or polygorskites). Smectites are three-layered clays having a layered sheet structure composed of two layers of silica tetrahedrons with a central layer of aluminum oxide in a dioctahedral crystal lattice and/or magnesium oxide in a trioctahedral crystal lattice. Such clays include montmorillonite (bentonite), beidellite, nontronite, volchonskoite, hectorite, saponite, sauconite and vermiculite. Attapulgites have a chain structure composed of chains of silica tetrahedrons linked together by octahedral groups of oxygens and hydroxyls containing aluminum and magnesium atoms.

Such clays are chemically available under various tradenames, such as, for example, Korthix, a bentonite clay from Georgia Kaolin Company, Inc. of Union, N.J.; Gelwhite GP, H, etc., a bentonite clay from E.C.C. America, Inc. of Atlanta, Ga.; Bentone EW, a highly processed hectorite clay from NL Chemicals, Inc. of Hightstown, N.J.; and Attagel 40, 50, etc., which are attapulgite clays from Engelhard Minerals and Chemicals Corporation of Edison, N.J.

The use of such smectite and/or attapulgite expandable clays in abrasive false-body fluid phase scouring cleanser compositions is disclosed in U.S. Pat. No. 3,985,668. As discussed therein the scouring composition comprises a relatively heavy, water-insoluble particulate material and a relatively light, water-insoluble particulate filler, both of which are suspended throughout a continuous false-body fluid phase formed by admixing an aqueous liquid with an inorganic colloid-forming agent which is present in a concentration ranging from about 1% to 10% by weight of the total composition. The clays disclosed in U.S. Pat. No. 3,985,668 as suitable for use as the inorganic colloid-forming agent are the expandable smectites and attapulgites hereinbefore mentioned.

It is also well known to use such inorganic colloid-forming smectite and/or attapulgite as thickening or suspending agents in liquid automatic dishwater detergent compositions in order to impart desired rheological properties to the composition. For example, U.S. Pat. No. 4,226,736 discloses a low-foaming machine dishwashing composition comprising an aqueous thickener, a non-ionic surfactant and water, in the form of a gel having a minimum yield point of at least 1170. The aqueous thickener is disclosed as being present in amount ranging from about 0.1 to 20 percent by weight of the total composition. Examples of composition formulations are presented in U.S. Pat. No. 4,226,736, incorporating Bentonite BC, a bentonite clay marketed by American Colloid Co., thickened with organic ammonium ions by admixing therewith triethanolamine, and Hi-Gel, also a bentonite clay consisting essentially of all montmorillonite.

A liquid automatic dishwater detergent (LADD) composition containing chlorine bleach and having thixotropic properties is presented in U.S. Pat. No. 4,740,327. The basic dishwater detergent formulation disclosed has a pH of about 10.5 to 13.5 and comprises approximately by weight: 8 to 35% sodium tripolyphosphate as a detergency builder; 2.5 to 20% sodium silicate as an alkalinity agent; 0 to 9% sodium carbonate as an optional alkalinity enhancing agent: 0.1 to 5% chlorine bleach stable defoamer/surfactant; 0.1 to 5% chlorine bleach stable, water-dispersible organic detergent active material; sodium hypochlorite in an amount sufficient to provide about 0.2 to 4% of available chlorine: a thixotropic thickener in an amount sufficient to provide the composition with a thixotropy index of about 2.5 to 10; and water in an amount effective to avoid destruction of the desired thixotropic properties, typically from about 45% to 75% by weight of the composition. The preferred thixotropic thickeners are stated to be the inorganic, colloid-forming clays of smectite and/or attapulgite types such as those disclosed in U.S. Pat. No. 3,985,668, and are generally presented in an amount ranging from 1.5 to 10% by weight of the composition, and preferably in an amount ranging from 2 to 5% by weight of the composition.

Variations of the basic thixotropic LADD formulation of U.S. Pat. No. 4,740,327 are presented in U.S. Pat. Nos. 4,752,409; 4,801,395 and 4,836,946. The incorporation of small amounts, such as 0.08 to 0.4 weight percent, of calcium, magnesium, aluminum or zinc stearate or other polyvalent metal salts of long chain fatty acids having 8 to 22 carbon atoms is disclosed in U.S. Pat. No. 4,752,409 as improving the physical stability of liquid gel-like compositions including thixotropic thickeners such as montmorillonite, attapulgite and hectorite-type clays. In U.S. Pat. No. 4,801,395, it is disclosed that the physical stability of such formulations may also be improved by incorporating into the composition small amounts, such as 0.02 to 0.4 weight percent, of long chain fatty acids having from 8 to 24 carbon atoms. Additionally, it is disclosed in U.S. Pat. No. 4,836,946 to add from 0.01 to 0.5% by weight of an alkali metal or ammonium fatty acid salt as a means to increase the apparent viscosity and physical stability of such a thixotropic LADD composition.

Although such expanding layer smectite and attapulgite type colloid-forming clays have proven effective as agents for imparting thixotropic properties to liquid or gel-like detergents or cleaners, in particular liquid automatic dishwater detergent compositions, they must be shipped as dry, particulate solids rather in the preferred form of a high solids aqueous slurry or dispersion, because of the extremely high viscosities associated with slurries or dispersions of such expanding smectite and attapulgite type colloid-forming clays even at low to moderate solids level. Accordingly, it is conventional commercial practice to ship such smectite and/or attapulgite clay based thickeners as a dry, particulate material and mix these thickeners with water just prior to usage to form a low solids, highly viscous aqueous dispersion typically at a solids level less than about 15% by weight and generally in the range of 5 to 10% solids by weight. This low solids, highly viscosity dispersion of smectite and/or attapulgite clay thickener is then added to the aqueous detergent or cleaner composition, typically as the last ingredient, to impart the desired thixotropic properties to the composition.

It would be advantageous to have a thickening or suspending agent for adding to an aqueous composition for imparting thixotropic properties thereto, which agent could be used as a relatively low viscosity, high solids aqueous slurry or dispersion at a solids level of at least 50% by weight, and preferably also shippable as a high solids aqueous slurry at a solids level at least 65% by weight. Having thickening agent that could be added to an aqueous composition as a high solids slurry would be advantageous in that additional water could be utilized in forming the basic aqueous composition to facilitate the dissolution of detergency builders, alkalinity agents and other components without exceeding overall water content limits upon addition of the thixotropic thickening agent. Further, the dust control problem and other handling problems associated with the use of a dry, particulate material would be avoided if the thickening or suspending agent could be shipped as a high solids aqueous slurry or dispersion. Further, the use of the high solids aqueous slurry or dispersion would eliminate the need for a separate make-down stage required of the dry, particulate materials.

Accordingly, it is an object of the present invention to provide a thickening or suspending agent for imparting thixotropic properties to an aqueous composition, which agent may be utilized in the form of a high solids aqueous slurry.

It is a further object of the present invention to provide such a thickening or suspending agent which may also be shipped as a high solids aqueous slurry.

It is an additional object of the present invention to provide a detergent or scouring composition incorporating such a thixotropic thickening or suspending agent.

It is a still further object of the present invention to provide a detergent composition incorporating such a thixotropic thickening or suspending agent, which composition is suitable for use as a liquid automatic dishwasher detergent.

SUMMARY OF THE INVENTION

In accordance with the present invention there is provided a thickening or suspending agent for imparting thixotropic properties to an aqueous composition comprising a kaolinite clay. While the thickening or suspending properties of the kaolinite is exhibited over a very broad range of particle size products, the kaolinite clay used advantageously has a particle size distribution of at least about 50% of the kaolin particles thereof have a particle size less than 2 microns equivalent spherical diameter, more preferably at least about 80% and, most preferably, at least about 95%. When utilized in a slurry form, the kaolinite clay based thickening or suspending agent most advantageously comprises an aqueous slurry of kaolinite particles at a solids level of at least 65% solids by weight.

Alternatively, the thickening or suspending agent of the present invention for imparting thixotropic properties to an aqueous composition may comprise a mixture of a kaolinite clay and a non-kaolinite selected from the group consisting of smectite clay, attapulgite clay and mixtures thereof, more advantageously as a mixture of equal parts of kaolinite clay and attapulgite clay, and most advantageously as a mixture of equal parts of a kaolinite clay and a bentonite clay.

The kaolinite containing thixotropic thickening or suspending agents of the present invention are particularly useful in liquid or gel-like detergent or scouring compositions for imparting thixotropic properties thereto at a level of concentration ranging from about 2% to about 5% by weight of the composition. Most advantageously, a liquid automatic dishwasher detergent composition is provided comprising approximately by weight: 5 to 70% alkali metal detergency builder; 2.5 to 20% sodium silicate; 0 to 5% chlorine bleach compound; 0 to 2.5% water dispersible organic detergent active surfactant; 0 to 10% alkali metal carbonate; 0 to 10% alkali metal hydroxide; 0 to 5% chlorine bleach stable foam depressant, water, and 2 to 5% thixotropic thickener containing a kaolinite clay.

DETAILED DESCRIPTION OF THE INVENTION

As noted hereinbefore, expanding smectite and attapulgite clays are well known as being useful as agents for imparting thixotropic properties to an aqueous composition. Kaolinite clays, however, have been generally considered as not being functional as agents for imparting thixotropic properties to an aqueous composition and have heretofore not been commercially employed as thixotropic thickeners or suspending agents.

As noted previously, smectites are three-layered clays having a layered sheet structure composed of two layers of silica tetrahedrons with a central layer of aluminum oxide in a dioctahedral crystal lattice and/or magnesium oxide in a trioctahedral crystal lattice. Attapulgites have a chain structure composed of chains of silica tetrahedrons linked together by octahedral groups of oxygens and hydroxyls containing aluminum and magnesium atoms.

However, kaolinite clays differ substantially in their structure from smectite and attapulgite clays. Kaolinite clays are characterized by a two-layer sheet structure consisting of one layer of silica tetrahedrons and one layer of alumina tetrahedrons. Kaolinite clays are chemically characterized an hydrous aluminum silicates of approximately the composition $2H_2O.Al_2O_3.2SiO_2$. It is generally accepted that kaolinite clays do not have the high swelling properties and the high cation exchange capacities associated with smectite clays.

Unexpectedly, it has now been discovered, as herein disclosed, that kaolinite clays can function at low solids level as a thixotropic thickener or suspending agent in aqueous compositions, particularly in those of high ionic strength, for example liquid automatic dishwasher detergent compositions. Most advantageously, it has been found almost paradoxically that kaolinite clays can be formed into relatively low viscosity aqueous dispersion at high solids loading, that is at a solids concentration of at least 50% weight, yet when incorporated into an aqueous composition at low solids loading, that is at a solids concentration of less than 10% by weight, yields an ultra-high viscosity, thixotropic system.

Typically, aqueous solutions exhibit substantially Newtonian flow characteristics, that is, the viscosity of the fluid maintains a substantially constant viscosity as shear rate increases. A thixotropic fluid on the other hand is characterized by a viscosity which not only varies substantially with changing shear rate, but which also varies with time at a given rate. The viscosity of a thixotropic fluid decreases from a relatively high initial value as shear rate increases to a substantially lower value. Then as the shear rate decreases, the viscosity again slowly increases, rebuilding to a value which is still less than the original high initial value. That is, as the shear rate is decreased, the recovery in viscosity is incomplete. Compared to the unsheared material, a lower viscosity for any given shear rate initially results. However, this loss in viscosity at any given shear rate is temporary and time dependent. In a truly thixotropic material, given sufficient time, the viscosity will completely rebuild to its original non-sheared value.

It has been found that fine particle size kaolinite clay is useful at low solids loading as an agent for imparting thixotropic properties to certain aqueous compositions, in particular liquid automatic dishwasher detergents. In the most preferred form of the kaolinite clay thixotropic thickener of the present invention, substantially all, that is at least about 95%, of the kaolin particles are of a particle size less than 2 microns equivalent spherical diameter. The functionally of kaolinite clay as a thixotropic thickener in aqueous compositions was heretofore unappreciated and was not to be expected as kaolinite aqueous dispersions do not typically exhibit thixotropic characteristics at low or high solids loading. In fact, purely aqueous dispersions of kaolinite clay and such dispersions containing a relatively small amount of water soluble dispersant, such as sodium carbonate, typically exhibit a non-thixotropic rheology wherein the viscosity of the dispersion increases slightly with increasing shear rate. That is, neat or substantially neat dispersions of kaolinite clay exhibit a dilatant flow characteristic. Expanding smectite clays of the type commonly commercially utilized as thixotropic agents exhibit a thixotropic characteristic in neat or substantially neat aqueous dispersions.

A comparison of the viscosity versus shear rate profile, and the Thixotropic Index associated therewith, for aqueous dispersions of kaolinite clay vis-a-vis aqueous dispersions of smectite clay is presented in Table I hereafter. The kaolinite clay used in forming the aqueous kaolinite dispersion was Kaomer 350, a fine-particle size kaolin paper coating clay (98% by weight less than 2 microns) produced and marketed Georgia Kaolin Company, Inc., Union, N.J. The smectite clay used in forming the aqueous smectite dispersion was Korthix VWH, a bentonite clay commercially marked by Georgia Kaolin Company, Inc., Union, N.J., as a thixotropic thickener. The Thixotropic Index indicated in Table I, and as used elsewhere herein, is defined as the ratio of the apparent viscosity at 10 RPM to the apparent viscosity at 100 RPM. The Thixotropic Index is a measure of the degree of thixotropy of the material, the greater the Thixotropic Index, the greater the thixotropic character of the material. Viscosity values are presented in centipoises at shear levels of 10, 20, 50 and 100 RPM's.

TABLE I

| Korthix VWH | Kaomer 350 | $Na_2CO_3$ | Viscosity, Centipoise at RPM Level | | | | |
|---|---|---|---|---|---|---|---|
| % | % | % | 10 | 20 | 50 | 100 | T.I. |
| 1.0 | — | — | 5.0 | 5.0 | 14.0 | 18.0 | 0.28 |
| 1.0 | — | 0.5 | 45.0 | 27.5 | 22.0 | 24.2 | 1.9 |

TABLE I-continued

| Korthix VWH | Kaomer 350 | $Na_2CO_3$ | Viscosity, Centipoise at RPM Level | | | | |
|---|---|---|---|---|---|---|---|
| % | % | % | 10 | 20 | 50 | 100 | T.I. |
| 2.0 | — | — | 170.0 | 97.5 | 56.4 | 47.2 | 3.6 |
| 5.0 | — | — | 3540 | 1920 | 808 | 44[illegible] | 8.0 |
| — | 1.0 | — | 2.0 | 5.0 | 6.0 | 10.5 | 0.19 |
| — | 1.0 | 0.5 | 5.0 | 7.5 | 7.0 | 12.5 | 0.40 |
| — | 2.0 | — | 5.0 | 7.0 | 7.0 | 11.5 | 0.43 |
| — | 5.0 | — | 8.0 | 7.5 | 9.0 | 14.5 | 0.55 |
| — | 50.0 | — | 28.0 | 28.0 | 32.0 | 42.4 | 0.66 |

As illustrated in Table I, the aqueous dispersion of bentonite clay exhibited a high degree of thixotropy at low solids levels of 2 to 5% by weight. However, the aqueous dispersion of kaolinite clay did not exhibit any thixotropic characteristics at all, but rather exhibited a dilatant flow characteristic. This dilatancy is a characteristic of kaolinite clay aqueous dispersions at both low and high solids loadings and has lead to the generally accepted belief that kaolinite clay is not suitable as a thixotropic thickening agent.

The surprising effectiveness of kaolinite clay as an agent for imparting thixotropic properties to an aqueous detergent composition was evaluated by incorporating Kaomer 350 in a typical liquid automatic dishwasher detergent (LADD) composition and compared with the thixotropic performance of Korthix VWH, as previously noted to be a bentonite clay commercially available as a thixotropic additive, in the same typical LADD composition. The LADD formulations used to evaluate the effectiveness of the thixotropic agents in the examples presented herein had the following concentration approximately by weight listed in the general order of addition when formulating the LADD compositions:

| | weight % |
|---|---|
| (a) Water-deionized | 45-50 |
| (b) Thixotropic clay thickener | 3-7.5 |
| (c) High mono stearyl acid phosphate, detergent active surfactant | 0.6 |
| (d) Sodium hydroxide (50% solution) | 2.0 |
| (e) Sodium carbonate | 5-12.0 |
| (f) Sodium tripolyphosphate | 20.0 |
| (g) Metso sodium metasilicate (anhydrous) | 11.0 |
| (h) Surfactant LW | 1.0 |
| (i) Sodium hydrochlorite (12.5% solution) | 10.0 |
| | 100.0 |

The total salt concentration, that is sodium tripolyphosphate, sodium carbonate and sodium silicate collectively, was maintained in the range of 38 to 45% by weight of the total composition, which salt concentration lies within the range of total salt concentration of 20 to 50 weight percent generally employed in commercial LADD compositions.

In make-up of the test LADD compositions, an aqueous slurry of the clay thickener was formed first and the remaining chemical ingredients added thereto. In all examples except IIIa, the aqueous clay slurry was prepared by adding the bentonite clay or the kaolinite clay to deionized water while stirring at low speed. After the addition of the clay was complete, i.e to a solids level of about 6% to about 10% by weight, the slurry was blunged at high speed for twenty minutes before addition of the chemical ingredients. In those formulations where the clay additive comprised both bentonite clay and kaolinite clay, the bentonite clay was dispersed in the deionized water prior to adding the kaolinite clay. In example IIIa, the kaolinite clay thickener was intially in the form of a 70% solids aqueous dispersion which was diluted with deionized water to 10.4% solids by weight before addition of the chemical ingredients.

After the clay slurry had been thoroughly dispersed as described, the chemical ingredients were slowly added, one at a time in the order indicated previously, while mixing at moderate speed. Adequate mixing time was allowed after each ingredient was added to maintain a uniform consistency prior to adding the next ingredient. Additionally, the mixture was allowed to cool at room temperature before addition of the surfactant and the bleaching compound, the last two ingredients.

Brookfield viscosity measurements of the sample LADD compositions were measured at room temperature using generally accepted procedures at shear levels of 0.5, 10, 20, 50 and 100 RPM's. The unsheared viscosity for each formulation is represented by the reading taken at 0.5 RPM when the reading became consistent. The viscosity profiles exhibited by the sample formulations are presented in Table II.

TABLE II

| Sample | Korthix VWH % | Kaomer 350 % | $Na_2CO_3$ % | Viscosity, Centipoise at RPM Level 0.5 | 10 | 20 | 50 | 100 | T.I. |
|---|---|---|---|---|---|---|---|---|---|
| I | 5.0 | — | 5.0 | 82.0M | 8.28M | 5.52M | 2.90M | 1.86M | 4.4 |
| II | 5.0 | — | 10.0 | 640.0M | 66.0M | 41.0M | 21.2M | 12.8M | 5.2 |
| III | — | 5.0 | 5.0 | 12.8M | — | — | — | — | — |
| IIIa | — | 5.0 | 5.0 | 14.0M | 1.3M | 0.84M | 0.50M | 0.35M | 4.7 |
| IV | — | 5.0 | 7.5 | 58.0M | — | — | — | — | — |
| V | — | 7.5 | 7.5 | 168.0M | — | — | — | — | — |
| VI | — | 5.0 | 10.0 | 244.0M | — | — | — | — | — |
| VII | — | 5.0 | 10.0 | 162.0M | 19.0M | 11.5M | 5.9M | 3.65M | 5.2 |
| VIII | — | 5.0 | 10.0 | 260.0M | 29.0M | 18.2M | 9.4M | 5.7M | 5.1 |
| IX(1) | — | 5.0 | 12.0 | 276.0M | 29.5M | 18.2M | 10.0M | 6.2M | 4.7 |
| X | 2.0 | 2.0 | 10.0 | 448.0M | 64.0M | 42.6M | 21.8M | 12.8M | 5.0 |

NOTE
(1) The NaOH concentration was reduced from 2.0% to 0%.

As illustrated in Table II, test LADD formulations incorporating kaolinite clay as a thixotropic additive in accordance with the present invention (see Samples VII, VIII and IX) exhibited a Thixotropic Index ranging from 4.7 to 5.2, which is comparable to the Thixotropic Index of the test LADD formulations identified as Samples I and II, both of which incorporated bentonite clay as the thixotropic additive. Despite the fact that an aqueous dispersion of the Kaomer 350 kaolinite clay exhibit no thixotropic characters at all, the very same kaolinite clay unexpectedly functioned as well as the commercially available bentonite clay (Korthix VWH) as an agent for imparting thixotropic properties to the LADD composition, and did so at the same low solids loading levels. The data further indicates that the unexpected thixotropic behavior of the kaolinite clay is associated with the high ionic strength of this type of aqueous formulation.

Although sodium carbonate is generally considered an optional ingredient in LADD compositions, but as noted in U.S. Pat. No. 4,740,327, is often needed in LADD compositions as a buffer to enable maintenance of the desired pH level, the inclusion of sodium carbonate at levels of about 10 weight percent of the composition appears to increase the apparent viscosity of the unsheared LADD composition whether the thixotropic additive is the kaolinite clay of the present invention or the prior art bentonite clay. Comparing the viscosity at 0.5 RPM of LADD Sample II to that of LADD Sample I shows that increasing the sodium carbonate concentration from 5 weight percent to 10 weight percent resulted in a nearly 8 fold increase in the unsheared viscosity of a LADD formulation incorporating the bentonite thixotropic additive at a 5 weight percent level. A comparison of the viscosity at 0.5 RPM of LADD Samples III, IV, VI, VII and VIII, shows that increasing the sodium carbonate concentration from 5 weight percent to 10 weight percent results in a 12 to 20 fold increase in the unsheared viscosity of a LADD formation incorporating the kaolinite clay based thixotropic additive of the present invention at the 5 weight percent level, but that further increasing the sodium carbonate loading to 12 weight percent results in very little further increase in the unsheared viscosity.

The kaolinite clay thixotropic additive of the present is also effective in combination with non-kaolinite clay thixotropic additivities. To evaluate the effectiveness of such a mixed clay thixotropic additive in LADD formulations, varying amounts of Kaomer 350 kaolinite clay and Korthix VWH bentonite clay were tested in sample LADD formulations and Brookfield viscosity measurements taken, which viscosities are presented in Table III.

TABLE III

| Sample | Korthix VWH % | Kaomer 350 % | $Na_2CO_3$ % | Viscosity, Centipoise at RPM Level 0.5 | 10 | 20 | 50 | 100 | T.I. |
|---|---|---|---|---|---|---|---|---|---|
| X | 1.0 | 1.0 | 10.0 | 90.0M | — | — | — | — | — |
| XI | 1.5 | 1.5 | 7.5 | 66.0M | — | — | — | — | — |
| XII | 2.0 | 2.0 | 10.0 | 448.0M | 64.0M | 42.6M | 21.8M | 12.8M | 5.0 |

As comparison of the Thixotropic Index of LADD Sample XII of 5.0 for a mixed kaolinite and bentonite thixotropic agent with the Thixotropic Indices of the samples in Table I shows that the mixed kaolinite and bentonite thixotropic agent of the present invention is as effective in imparting thixotropic properties to a LADD formulation at the 4 weight percent level (50% Kaomer 350/50% Korthix VWH) as either the commercial bentonite agent alone or the kaolinite thixotropic agent of the present invention alone at the 5 weight percent level. The mixed Kaomer 350/Korthix VWH additive yielded an LADD formulation (Sample XII) having an unsheared viscosity of 448.OM at the 4 weight percent level which compares well with the unsheared viscosity of LADD formulation (Sample II) incorporating the Korthix VWH, the commercial bentonite thixotropic thickener only, at a 5 weight percent level.

The effect of kaolin particle size on the effectiveness of the kaolinite thixotropic additive of the present invention as an agent for imparting thixotropic properties to a LADD formulation was evaluated by testing kaolinite clays of different particle size in sample LADD formulations. Brookfield viscosity measurements were taken as presented in Table IV. LADD Sample A incorporates the commercial Kaomer 350 kaolin clay which has a particle size distribution of 98% by weight particles less than 2 microns. LADD Sample B incorporates a commercial Kaopaque 10 kaolin clay, manufactured and marketed by Georgia Kaolin Company, Inc., Union, N.J., which has a coarser particle size distribution of only 80% by weight particles less than 2 microns. LADD Sample C incorporates a commercial Velvacast kaolin clay, manufactured and marketed by Georgia Kaolin Company, Inc., Union, N.J., which has a very coarse particle size distribution of only 40% by weight particles less than 2 microns. LADD Sample D incorporates an experimental ultrafine kaolin product which is comprised of particles all of which are less than one micron in equivalent spherical diameter.

TABLE IV

| Sample | Kaolinite % | $Na_2CO_3$ % | Viscosity, Centipoise at RPM Level 0.5 | 10 | 20 | 50 | 100 | T.I. |
|---|---|---|---|---|---|---|---|---|
| A | 5.0 | 10.0 | 260.0M | 29.0M | 18.2M | 9.4M | 5.7M | 5.1 |
| B | 5.0 | 10.0 | 196.0M | 20.5M | 12.7M | 7.3M | 4.7M | 4.3 |
| C | 5.0 | 10.0 | 164.0M | 20.5M | 12.7M | 6.0M | 4.4M | 4.7 |
| D | 5.0 | 10.0 | 540.0M | 75.2M | 48.0M | 24.8M | 14.6M | 5.1 |

Comparing the viscosity profiles and Thixotropic Indices presented in Table IV show that each of the kaolinite, irrespective of particle size, were functional as thixotropic thickeners in the sample LADD formulation, but that a finer particle size distribution is preferred as the data indicates that the finer the particle size, the higher the initial unsheared viscosity of the formulation.

While the kaolinite clay based thixotropic additives disclosed herein are particularly described in effectiveness in conjunction with application to the sample LADD formulations hereinbefore specified, it will be readily understood by one of ordinary skill in the art that the kaolinite clay based thixotropic additives of the present invention may applied as effectively to other highly ionic strength, aqueous formulations including other thixotropic detergent or cleansing compositions, such as the scouring paste formulations described in the aforementioned U.S. Pat. No. 3,985,668, and the various liquid automatic dishwasher detergent compositions described in U.S. Pat. Nos. 4,226,736; 4,740,327; 4,752,409; 4,801,395; and 4,836,946.

We claim:

1. A thickening agent useful for imparting thixotropic properties to an ionic detergent composition, said thickening agent comprising a mixture of kaolinite clay and a non-kaolinite clay selected from the group consisting of smectite clay, attapulgite clay and mixtures thereof, wherein said kaolinite clay comprises kaolin particles wherein at least about 50% by weight of said particles have a particle size less than 2 microns equivalent spherical diameter.

2. A thickening agent as recited in claim 1 wherein said kaolinite clay comprises kaolin particles wherein at least about 80% by weight of said particles have a particle size less than 2 microns equivalent spherical diameter.

3. A thickening agent as recited in claim 1 wherein said kaolinite clay comprises kaolin particles wherein at least about 95% by weight of said particles have a particle size less than 2 microns equivalent spherical diameter.

4. A thickening agent as recited in claim 1 wherein said mixture consists of about equal parts of the kaolinite clay and of the non-kaolinite clay.

5. A thickening agent as recited in claim 1 comprising a mixture of a kaolinite clay and a bentonite clay.

6. A thickening agent as recited in claim 5 wherein said mixture consists of about equal parts of the kaolinite clay and of the bentonite clay.

7. A thickening agent as recited in claim 5 wherein said kaolinite clay comprises kaolin particles wherein at least about 50% by weight of said particles have a particle size less than 2 microns equivalent spherical diameter.

8. A thickening agent as recited in claim 5 wherein said kaolinite clay comprises kaolin particles wherein at least about 80% by weight of said particles have a particle size less than 2 microns equivalent spherical diameter.

9. A thickening agent as recited in claim 5 wherein said kaolinite clay comprises kaolin particles wherein at least about 95% by weight of said particles have a particle size less than 2 microns equivalent spherical diameter.

10. An aqueous thixotropic automatic dishwasher composition comprising approximately by weight:

a. 5 to 70% alkali metal detergency builder;
b. 2.5 to 20% sodium silicate;
c. 0 to 5% chlorine bleach compound;
d. 0 to 25% water-dispersible organic detergent active surfactant;
e. 0 to 10% alkali metal carbonate;
f. 0 to 10% alkali metal hydroxide;
g. 0 to 5% chlorine stable foam depressant;
h. 2 to 5% thixotropic thickener comprising a kaolinite clay wherein said clay has a particle-size distribution wherein at least about 50% by weight of said clay particles are less than 2 microns in equivalent spherical diameter; and
i. water.

11. A detergent composition comprising:

a. a detergency builder;

b. sufficient alkalinity agent to impart an alkaline pH to said composition;

c. a thixotropic thickener for imparting thixotropic properties to said composition, said thixotropic thickener comprising about 2.0 to about 5.0% by weight of a kaolinite clay being present in an amount sufficient to provide said composition with a Thixotropy Index of about 2 to 10, wherein said clay has a particle-size distribution wherein at least about 50% by weight of said clay particles are less than 2 microns in equivalent spherical diameter; and d. water.

12. A detergent composition as recited in claim 11 wherein said kaolinite clay has a particle-size distribution wherein at least about 80% by weight of said clay particles are less than 2 microns in equivalent spherical diameter.

13. A detergent composition as recited in claim 11 wherein said kaolinite clay has a particle-size distribution wherein at least about 95% by weight of said clay particles are less than 2 microns in equivalent spherical diameter.

14. A detergent composition as recited in claim 11 wherein said detergency builder is present in said composition in an amount ranging from about 5% to about 70% by weight and is selected from the group consisting of the alkali metal salts of polyphosphates, tripolyphosphates, carbonates, citrates, nitrilotriacetates, carboxymethyloxysuccinates, polyacrylates and mixtures thereof.

15. A detergent composition as recited in claim 14 wherein said alkalinity agent is present in said composition in an amount sufficient to adjust the pH of said composition to at least 9.0, said alkalinity agent being selected from the group consisting of alkali metal silicates, alkali metal hydroxides, alkanolamines and mixtures thereof.

16. A detergent composition as recited in claim 15 wherein said kaolinite clay comprises about 2.0 to about 5.0% by weight of said composition.

17. A detergent composition as recited in claim 16 wherein said kaolinite clay has a particle-size distribution of at least about 95 percent by weight less than 2 microns equivalent spherical diameter.

18. A detergent composition as recited in claim 15 further comprising a chlorine bleach compound in an amount sufficient to provide about 0.2 to about 4% available chlorine.

19. A detergent composition as recited in claim 15 further comprising a surfactant.

20. A detergent composition as recited in claim 15 further comprising a foam depressant.

* * * * *